US007795555B2

(12) United States Patent
Benz et al.

(10) Patent No.: US 7,795,555 B2
(45) Date of Patent: Sep. 14, 2010

(54) PROCESS FOR DETERMINING WHETHER USED FRICTION ELEMENTS MAY BE RETURNED TO SERVICE

(75) Inventors: Eric W. Benz, Peoria, IL (US); Peter W. Offutt, Mossville, IL (US); Thomas R. Foster, Chillicothe, IL (US); Josh Bero, Green Bay, WI (US)

(73) Assignee: Caterpillar Inc, Peoria, IL (US)

( * ) Notice: Subject to any disclaimer, the term of this patent is extended or adjusted under 35 U.S.C. 154(b) by 601 days.

(21) Appl. No.: 11/811,411

(22) Filed: Jun. 8, 2007

(65) Prior Publication Data

US 2010/0187163 A9 Jul. 29, 2010

(51) Int. Cl.
*B07C 5/00* (2006.01)

(52) U.S. Cl. ..... 209/576

(58) Field of Classification Search ..... 209/576, 209/587

See application file for complete search history.

(56) References Cited

U.S. PATENT DOCUMENTS

| | | | | |
|---|---|---|---|---|
| 4,255,739 | A * | 3/1981 | Lang | 340/461 |
| 4,576,482 | A * | 3/1986 | Pryor | 356/612 |
| 4,869,813 | A * | 9/1989 | Bailey et al. | 209/538 |
| 5,054,918 | A | 10/1991 | Downing et al. | |
| 5,127,736 | A * | 7/1992 | Neiheisel | 356/602 |
| 5,877,858 | A | 3/1999 | Kerstens et al. | |
| 6,105,422 | A | 8/2000 | Pollock et al. | |
| 6,301,950 | B1 | 10/2001 | Cotterill et al. | |
| 6,460,659 | B1 | 10/2002 | Schaffer et al. | |
| 6,741,342 | B2 | 5/2004 | Butikofer et al. | |
| 2009/0046296 | A1 * | 2/2009 | Kilpatrick et al. | 356/484 |

FOREIGN PATENT DOCUMENTS

| | | |
|---|---|---|
| CA | 2 287 550 | 4/2001 |
| DE | 198 55 455 | 6/1999 |
| EP | 0 131 710 | 1/1985 |
| JP | 2005257692 | 9/2005 |

OTHER PUBLICATIONS

Dochio et al., Design and Perfomrance of an Optical Sensor for the Measurement of Surface Roughness and Waviness, Jun. 15-16, 1999, International Society of Optical Engineering, vol. 3823, pp. 160-163.*

* cited by examiner

*Primary Examiner*—Patrick Mackey
*Assistant Examiner*—Michael E. Butler
(74) *Attorney, Agent, or Firm*—Liell & McNeil

(57) ABSTRACT

A sorting process for used friction elements such as friction discs is provided, including determining whether the friction elements are heat compromised based at least in part on a wave scattering property of at least one frictionally interactive face of each of the used friction elements. Suitable friction elements may be sorted into an acceptable category, and unsuitable friction elements sorted into a scrap category. A method of assembling a machine system such as a transmission includes determining suitability of a friction element for service therein by measuring a wave scattering property such as reflectivity of at least one frictionally interactive face of the friction element, and coupling the friction element with the same or a different machine system for returning to service therein based at least in part on the determination of suitability.

9 Claims, 2 Drawing Sheets

PROCESS FOR DETERMINING WHETHER USED FRICTION ELEMENTS MAY BE RETURNED TO SERVICE

TECHNICAL FIELD

The present disclosure relates generally to the field of remanufacturing, and relates more particularly to processes for sorting used friction elements and determining their suitability for returning to service in a machine system.

BACKGROUND

A wide variety of machine systems utilize friction elements such as friction discs for transferring energy between machine components. Torque converters, clutches, brakes and various other machine systems, for example, employ friction discs to provide a rotational coupling or frictional energy transfer between components in a machine system. Slipping of the friction element will cause wearing down of the friction material over time. After a certain degree of wear, the friction elements typically need to be replaced, or the machine system of which they are a part needs to be replaced.

It is common for a machine system employing such friction elements to be serviced, remanufactured or replaced prior to at least some of its constituent friction elements reaching a degree of wear that renders them unsuitable. In other words, machine systems such as transmissions, clutches, brakes, etc. may be sent for service or remanufacturing because part of the system is worn or not functioning properly, while the friction elements themselves remain functionable and are not overly worn. Nevertheless, the friction elements are typically replaced with new friction elements during such servicing or remanufacturing. This is done because it has heretofore been difficult to verify with a high degree of certainty that the friction elements are in good condition. Thus, all the used friction elements are typically scrapped and replaced with new friction elements to ensure that only good functioning friction elements are included in the repaired or remanufactured system.

While the cost of an individual friction element will often be fairly low, the relatively large numbers of friction discs used in certain machine systems such as transmissions and clutches renders a 100% scrapping approach highly inefficient and economically wasteful.

The economic disincentive to scrapping otherwise suitable used friction discs has been recognized for some time. With regard to friction discs known in the art as "low energy" friction discs, remanufacturers have recognized that the color of the friction material can indicate its suitability for further service. Other friction elements, in particular "high energy" friction discs, often a composite of Kevlar™, paper and the like employed in a lubricated environment, cannot indicate their suitability for further use by their color due to their unique material properties and design characteristics. According to some estimates, at least 50% of used high energy friction elements might actually be suitable for returning to service in a machine system. But because the techniques for quickly and consistently verifying their suitability have not heretofore been available, all are typically scrapped.

SUMMARY OF THE DISCLOSURE

The present disclosure provides a sorting process for used friction elements configured to transfer energy between components in a machine system. The sorting process includes receiving friction elements removed from service in at least one machine system, each of the friction elements having at least one frictionally interactive face. The sorting process further includes determining whether the friction elements are heat compromised based at least in part on a wave scattering property of the at least one frictionally interactive face, and sorting the friction elements into one of at least two categories based at least in part on whether the friction elements are heat compromised.

The present disclosure also provides a method of determining suitability for returning a friction element to service in a machine system. The method includes determining a wave scattering property of at least one frictionally interactive face of the friction element, the friction element being configured to transfer energy between machine components via the at least one frictionally interactive face. The method further includes determining whether the friction element is heat compromised based at least in part on the wave scattering property.

The present disclosure also provides a method of assembling a machine system. The method includes determining suitability of a friction element for service in a machine system, including measuring a wave scattering property of at least one frictionally interactive face of the friction element. The method further includes coupling the friction element with a machine system for service therein based at least in part on the determination of suitability.

DETAILED DESCRIPTION

Figure 1:
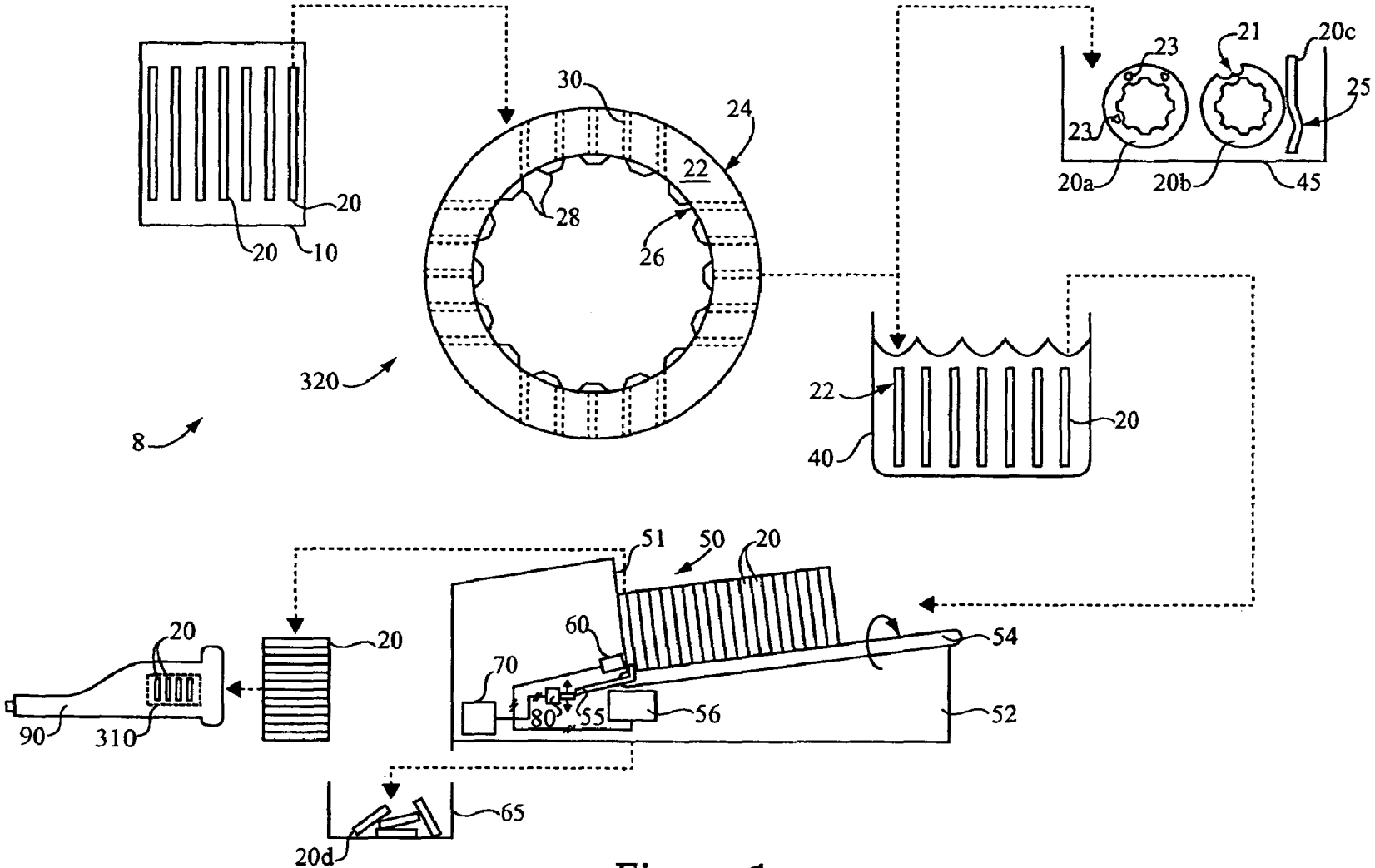
FIG. 1 is a schematic view of a system for remanufacturing a machine system in accordance with the present disclosure.

Referring to FIG. 1, there is shown a remanufacturing system 8 wherein used friction elements such as friction discs 20 removed from service in a machine system can be sorted and their suitability for returning to service in the same or another machine system evaluated. Friction elements amenable to remanufacturing via the systems and processes of the present disclosure include those used to transfer torque between rotatable machine components such as clutches and the like, as well as friction elements which transfer energy between a rotating machine component and a non-rotating machine component such as in a brake system. While many such friction elements comprise porous friction discs used, for example, in conjunction with a lubricating fluid, the present disclosure is not thereby limited. Reusing used friction elements instead of replacing them with new friction elements will result in substantial economic advantages over earlier strategies.

A clutch pack 10, such as might be used in a transmission, is part of one machine system which is amenable to remanufacturing in the manner described herein and is shown in FIG. 1. Clutch pack 10 has been removed from a machine system and includes a plurality of friction discs 20 shown edge-on therein. Thus, in the embodiment shown in FIG. 1 clutch pack 10 may have arrived at a remanufacturing center for rebuild. Its friction discs 20 will subsequently be removed, sorted and their suitability for returning to service evaluated. An exemplary friction disc from clutch pack 10, identified with reference numeral 320, is shown removed therefrom and illustrated as it would appear viewed face-on in FIG. 1.

Other friction discs, removed from clutch pack 10 or other clutch packs and the like are also shown at various locations within system 8 and are also identified each with reference numeral 20 and similar reference numerals. As further described herein, all of friction discs 20 may be removed from clutch pack 10, examined for wear or damage, cleaned and evaluated for suitability for returning to service. Those friction discs which are suitable may be selected for returning to service in the same or another clutch pack 310, which may subsequently be re-assembled and placed in service in a transmission 90, potentially the same transmission from which the respective clutch pack was removed. While much of the present description focuses on the sorting and evaluation of friction discs 20 used in transmission clutch packs, the present disclosure is not thereby limited and other friction elements such as brake discs, conical clutches and a variety of other friction elements could be processed and remanufactured via a system and method similar to that shown and described with regard to FIG. 1.

It should further be appreciated that system 8 is intended to be illustrative only and the particular remanufacturing strategy chosen will depend upon a variety of factors such as, of course, the type of friction elements, the type of machine systems from which the friction elements are removed and to which they may be returned, ease of automation of certain of the processes and various other factors. System 8 is contemplated only to be one practical implementation strategy, and may thus be substantially modified from the embodiment shown in FIG. 1. Furthermore, rather than automating the remanufacturing process, it could be performed manually.

As mentioned above, friction elements remanufactured according to the present disclosure may include friction discs. Disc 320 in FIG. 1 includes certain of the attributes common to such friction discs known in the art as "high energy" friction discs. Accordingly, the description herein of disc 320 should be understood to refer generally to discs remanufactured via system 8, although disc 320 is referred to separately herein for convenience. It is common for high energy friction discs to be comprised of materials such as Kevlar™ and paper, together forming a composite which, when used in a "wet" friction disc environment, i.e. with lubricating fluid, provides an effective means for transferring energy between machine components. The example disc 320 shown in FIG. 1 may include a frictionally interactive face 22 on only one side, or both sides, (only one side is shown in FIG. 1). Disc 320 may further include an outer diameter 24, an inner diameter 26 and a plurality of spline teeth 28. Teeth 28 may extend inwardly or outwardly from inner diameter 26 or outer diameter 24, respectively, and are configured to rotatably fix disc 320 with a rotating machine component in a well-known manner. Disc 320 may further include a plurality of machined or otherwise preformed oil grooves 30, the depth of which can indicate the extent to which frictionally interactive material has worn away from face 22. Grooves 30 can thus provide a visual or machine-readable indication of the extent of wear of disc 320.

Accordingly, when disc 320 is removed from clutch pack 10, a preliminary process step in determining its suitability for returning to service may be inspecting disc 320 for indicia of wear, such as relative depth of grooves 30. Disc 320 may also be inspected for damage such as non-planarity, chips, gouges, separation of friction material from its metal substrate, embedded materials, etc. System 8 may include a variety of processing stations. Thus, when disc 320 is initially removed from clutch pack 10, it may be inspected, either by a technician or by some other means, for indicia of wear and damage at a first station. Discs worn beyond a point that is considered acceptable, or damaged, may be sent to a scrap receptacle 45. In FIG. 1, scrap receptacle 45 is shown having therein a variety of discs which are unsuitable for returning to service because of damage. These might include a first disc 20*a* having material 23 embedded therein, a second disc 20*b* having a chip 21 and a third disc 20*c* that is warped and has a non-planar portion 25. Each of discs 20*a*, 20*b* and 20*c* may be determined unsuitable for returning to service without having to subject them to further processing in system 8. The present disclosure is not limited in this regard, however, and rather than initially rejecting discs having such characteristics, a later inspection might take place, for example just prior to re-assembling them into transmission 90.

It should still further be appreciated that inspection of clutch pack 10 itself, or a machine system from which it has been removed, may also provide indications that discs therein are unsuitable for returning to service and should be immediately scrapped rather than otherwise processed and evaluated. For instance, it has been discovered that use of incorrect transmission fluid type may cause or be associated with disc damage, excess wear or other problems. One example inspection technique might include comparing a color of lubricating fluid in a transmission returned for service with the color of fluid prescribed or otherwise suitable for use with that transmission type. If the color of fluid in the used transmission does not match the color of the prescribed fluid, the discs could be scrapped rather than further evaluated. Such an inspection might be performed visually or with the use of any of a variety of suitable commercially available color scanners. Very darkly colored fluid might also indicate that the transmission, etc. has experienced excessive temperatures likely to heat compromise the friction discs therein. Also, the presence of relatively large amounts of loose material and the like in a transmission may indicate that the transmission or its components, such as its friction discs, have been damaged or stressed. Draining of the fluid and visual or machine inspection might be used to detect the presence of metal chips, or friction disc material, in the transmission fluid. Accordingly, those skilled in the art will appreciate that various issues might be revealed prior to completely disassembling a clutch pack or other machine component for remanufacturing which would indirectly indicate that friction elements used therein are not likely to be suitable for returning to service.

Discs which pass an initial inspection in system 8 may be subjected to a cleaning process in a cleaning apparatus, for example a non-aqueous cleaning process, wherein residual oil and the like is removed in preparation for further evaluation of discs 20. Cleaning is necessary in some environments where removal of the oil film is necessary for the to be described later scanning step. In other environments cleaning is optional. From cleaning apparatus 40, a plurality of discs 20 may be transferred to a testing apparatus 52 configured to further evaluate suitability of friction discs 20 for returning to service in a machine system such as transmission 90. Another scrap receptacle 65 may be provided, allowing friction discs 20*d* which do not pass tests performed via apparatus 52 to be sorted directly to scrap. While it is contemplated that testing apparatus 52, and other stations in system 8 wherein discs 20 are evaluated, will typically sort the respective discs into a "suitable" category or an "unsuitable," i.e. scrap, category, it should be appreciated that the present disclosure is not thereby limited. For instance, depending upon disc type, it might be possible at various points within system 8 to sort discs into more than two categories based on their theoretical remaining service life, for example, zero remaining service life, fifty percent or seventy-five percent, etc.

Testing apparatus 52 may include a set of parallel rollers 54, one of which is shown, whereupon a stack of discs 20 may be positioned. A reader 60 which is configured to scan each of the friction discs 20 may be provided which is configured to determine suitability of friction discs 20 for returning to service. Reader 60 may be mounted to a housing 52 of apparatus 50 such that discs 20 may be serially fed, for instance assisted by gravity, to a position against a stop 51, for example a polished, low friction surface, at which reader 60 can scan one or more regions of each disc's frictionally interactive face 22. Rollers 54 may be rotated via a drive motor 56 to position each disc 20 at different radial orientations relative to reader 60 for this purpose. Rollers 54 may thus be positioned at a slope to allow gravity to assist in feeding friction discs 20 towards reader 60. Other means for feeding and/or re-orienting discs 20 might also be used, and an operator could also perform the feeding, positioning and sorting tasks. In one embodiment, an operator could be directed to manually sort discs scanned with reader 60 via the presence or color of lights illuminated on testing apparatus 52. A combination transfer/ejection device 55 may be provided which ejects discs 20 from a position in front of reader 60, and permits the next disc 20 to move to a scanning position. Device 55 might be automated, or alternatively actuated by an operator. Apparatus 52 may further include a processor 70 configured to receive signals from reader 50 and responsively control an actuator 80 configured to move transfer/ejector device 55 to sort discs 20 into one of at least categories, for example a suitable category for discs to be re-assembled into transmission 90 and an unsuitable category for discs 20*d* which are sent to scrap receptacle 65. Processor 70 could also be used to illuminate lights or the like for signaling an operator as to which category a given disc should be sorted.

As apparent from the foregoing description, one aspect of the present disclosure may include sorting used friction discs 20, or other friction elements, via the use of reader 60. In particular, reader 60 may be used to determine whether friction elements are heat compromised. While friction elements other than friction discs 20 may be evaluated and remanufactured as described herein, the present description of exemplary sorting and suitability determination of friction discs 20 should be understood to refer to any friction elements having characteristics making them amenable to glazing, further described herein, wherein a wave scattering property of a frictionally interactive face is altered due to excessive heat being absorbed by the friction element while in service.

As described above, use, and in particular misuse, of a machine system that includes friction discs 20 can cause some of all of them to become glazed. This is believed to be due at least in part to excessive friction-generated heat which causes certain of the materials making up friction discs 20 to soften and even melt, compromising the friction discs' ability to function as desired. In particular, glazing of the material is believed to reduce at least the dynamic coefficient of friction and possibly the static coefficient of friction of the frictionally interactive face. It should be appreciated that this phenomenon can result in failure, or out of specification operation, of the friction discs prior to a point at which the extent of wear would otherwise render them unsuitable. Thus, system 8 and similar systems and related processes will allow discs which are not excessively worn, and thus theoretically capable of further service, to be sorted based on whether they are heat compromised. As indicated above, it is estimated that 50% or more of presently scrapped discs might be returned to service. At four to five clutch packs per transmission, with four to six friction discs per clutch pack, it is clear that salvaging of a relatively large number of discs is possible even in smaller scale remanufacturing operations. Once excessively worn discs and those which have been heat compromised are separated out as described herein, many of the discs which would have been formerly scrapped may be saved. This is contemplated to substantially reduce the costs associated with purchasing or manufacturing all new discs for placing in service in remanufactured or new machine systems.

It has been discovered that a wave scattering property such as reflectivity of light of frictionally interactive face 22 relates to whether friction discs 20 are heat compromised. If they are heat compromised, they may be scrapped. If discs 20 are not heat compromised, and are otherwise suitable for returning to service, they may be re-assembled into clutch pack 310 and a machine system such as transmission 90 for further use. The wave scattering property of frictionally interactive face 22 may be determined by transmitting light toward face 22, and sensing light reflected from face 22. In one embodiment, processor 70 may be configured to compare an intensity of light transmitted toward face 22 with an intensity of light reflected from face 22. In other embodiments, acoustic energy such as ultrasound might be used, hence, the "wave scattering property" of interest should be understood as not limited to light scattering properties, e.g. reflectivity or reflectance.

Figure 2:
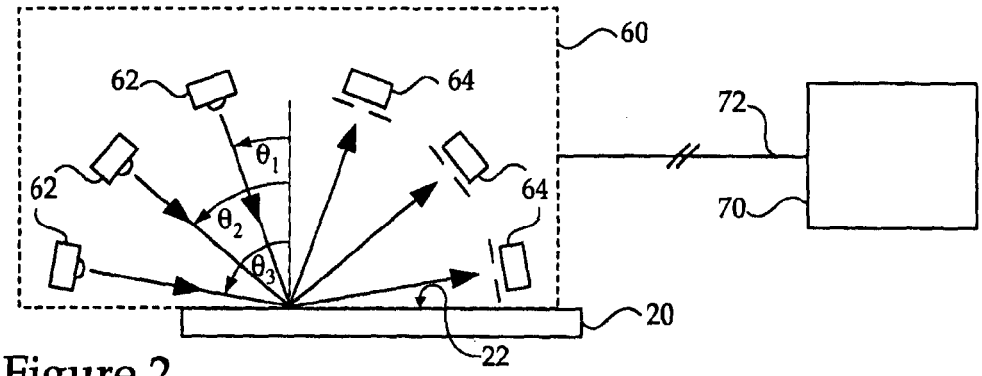
FIG. 2 is a schematic illustration of part of a testing apparatus for determining suitability of used friction elements for returning to service according to one embodiment.

Turning now to FIG. 2, there is shown schematically a view of reader 60 shown coupled with processor 70 via a communication line 72. Reader 60 may include one or more emitters 62 configured to transmit light such as a beam of coherent light toward face 22 of disc 20, and one or more sensors 64 configured to sense light reflected from face 22. In one embodiment, reader 60 may include three emitters 62 and three sensors 64, each disposed at different angles to allow light to be transmitted toward face 22 at three angles of incidence and reflected light to be sensed at three angles of reflectance, the angles of incidence and angles of reflectance being respectively equal. Light may be transmitted toward face 22 at about 20°, about 60° and about 80° relative to a line normal to face 22, and sensed at corresponding angles of reflection. Thus, when a disc 20 is positioned via apparatus 50 such that reader 60 can scan it, light may be transmitted from three separate angles of incidence, and corresponding angles of reflection may be scanned. A plurality of regions of face 22 may be scanned, typically less than an entire area of face 22, for example by rotating each disc 20 via rollers 54 less than a full rotation a plurality of times, each time placing a different region of disc 20 in front of reader 60 for scanning. It may also be desirable to scan regions of each face 22 that do not include grooves 30 as grooves 30 may scatter light and thus affect the readings. In other embodiments, the angle(s) at which reflected light is sensed might be different from the angle(s) at which it is transmitted. Still other versions might include sensing scattered light rather than reflected light.

As indicated above, friction discs 20 may be porous. Discs 20 which have been heat compromised will typically have absorbed too much heat, allowing certain of the disc materials to at least partially melt and thereby lessen the porosity. Heat compromised discs may have less total pore area available for lubrication fluid to pass through, and in most instances will not function as well as a disc having a desired porosity, having a tendency to slip excessively and then abruptly lock up, if at all. New discs, or discs which are used but not heat compromised, will in contrast tend to have a relatively greater porosity than discs which have absorbed too much heat. Discs having a relatively more porous face 22 may tend to scatter light more than discs which are heat compromised and therefore less porous. Accordingly, the intensity of reflected light for heat compromised discs tends to be relatively greater than the intensity of reflected light for non-heat compromised discs which are potentially suitable for returning to service.

While various strategies are contemplated for actually determining what proportion of light is reflected at an angle of reflectance equal to an angle of incidence, one practical implementation strategy will be subtracting sensed light intensity from transmitted light intensity for each of a plurality of angles, $\theta_1$, $\theta_2$ and $\theta_3$, then averaging the resulting values, to determine whether a threshold level of reflectance for the disc is present. If face 22 is determined to have a reflectance value or "index value" above the threshold, then the corresponding disc 20 may be sorted to scrap. If the reflectance value is below the threshold, the corresponding disc may be sorted to a suitable category and eventually returned to service.

To achieve the above sorting and suitability determination it may be necessary to calibrate reader 60. This may be done empirically by determining reflectance values, or index values, for a plurality of discs, then placing the discs in a test rig and actually determining their dynamic and/or static coefficients of friction. It should be appreciated that the index values corresponding to a "suitable" disc may vary based upon the materials from which the subject friction elements are made, and the finish of the surface. For example, materials having a relatively high inherent reflectivity (and thus a low wave scattering property) such as high gloss polymeric materials may tend to have relatively higher reflectance values even when still suitable for service in a machine. Other materials such as those including paper and/or dull elastomeric materials may be relatively less glossy and, hence, relatively lower reflectance values (and thus higher wave scattering property) may correspond to suitability for returning to service.

Further, certain friction elements may have surfaces which are relatively rougher than others, apart from the materials from which they are made. Rougher surfaces tend to inherently scatter more light, being thus associated with inherently lower reflectivity for both suitable and unsuitable discs. Further still, relatively more reflective materials may best be evaluated with light transmitted and reflected at relatively smaller angles relative to a line normal to the disc face as compared with relatively less reflective materials, as distinctions between suitable versus unsuitable friction elements based on reflectivity or other wave scattering properties may be more apparent at such smaller angles. Finally, different spectra of light might be found to be better suited to different materials, as reflectance of certain wavelengths may differ based on light absorption by the frictionally interactive materials of the friction element.

INDUSTRIAL APPLICABILITY

Because it is often difficult, particularly with regard to certain types of friction elements, to readily determine whether they remain suitable, common practice has been to replace all friction elements in a machine system when it is broken down for remanufacturing or even service. Furthermore, actual wear is not the only indicia of suitability and other characteristics of such discs such as whether they have been subjected to damaging heat have not heretofore been readily ascertainable for many friction discs. As discussed herein, one characteristic affecting whether friction discs and other friction elements, in particular high energy friction elements, are suitable for further service relates to whether the friction elements have been "glazed" due to excessive heat. While the expected eventual failure mode for certain friction elements is wear, in some instances the friction elements may become prematurely ineffective even when not excessively worn where their frictionally interactive surfaces become glazed. This can result from abusive shifting practices, "riding" brakes and other activities pushing the design limits of the friction elements and actually melting or smearing some of the constituent materials. Glazing has heretofore been difficult to detect without actually testing the efficacy of the friction elements in the machine in which they are used or in a test rig or machine.

Figure 3:
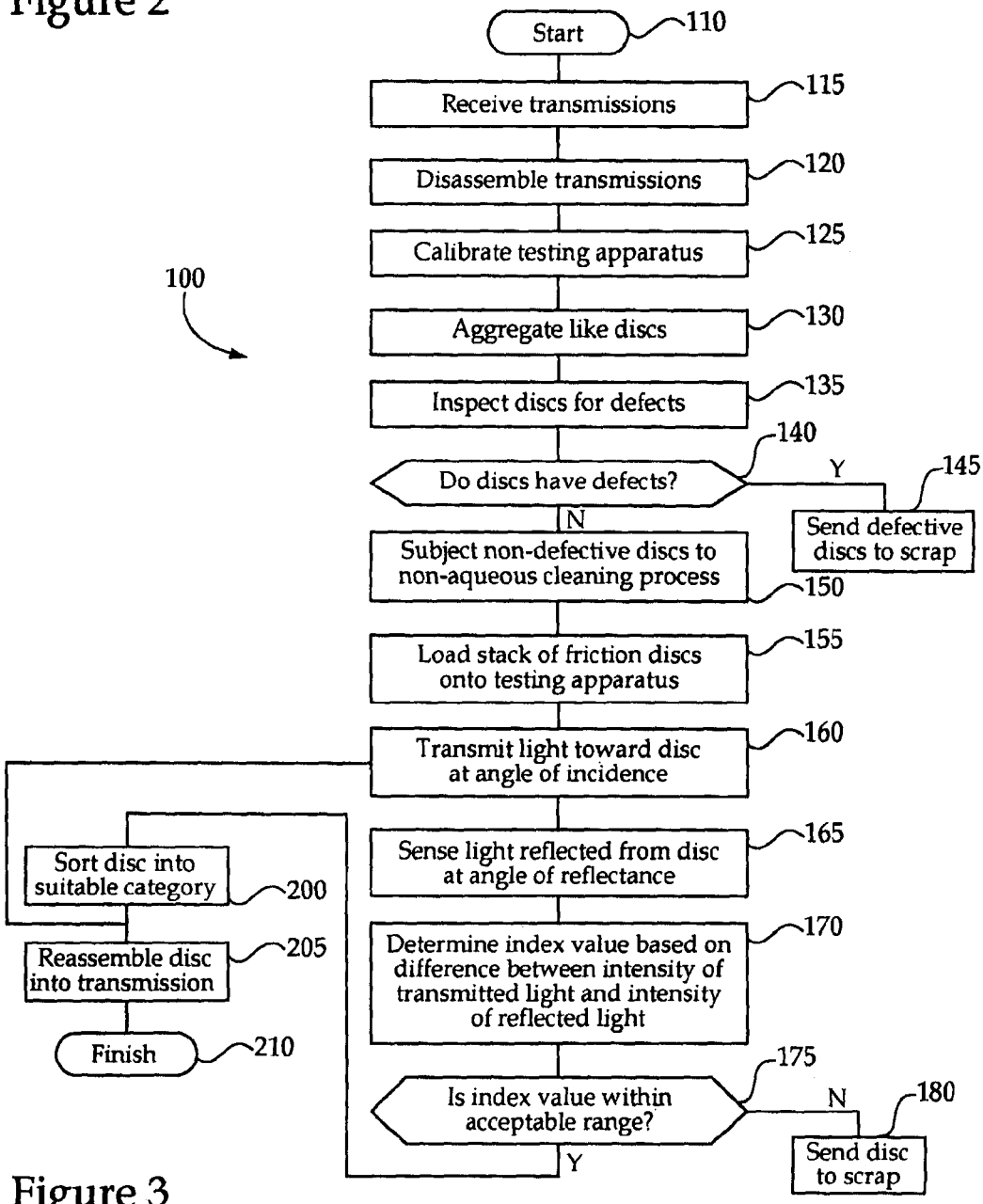
FIG. 3 is a flowchart illustrating an exemplary remanufacturing process according to one embodiment.

Referring now to FIG. 3, there is shown a flow chart illustrating a remanufacturing process 100 according to the present disclosure. Process 100 may begin at a Start 110, and proceed to step 115 wherein transmissions are received for remanufacturing. From step 115, process 100 may proceed to step 120 wherein the transmissions are disassembled. During or prior to disassembling the transmissions, they might be checked to determine whether a correct fluid type has been used therein, whether loose material is present in the transmission fluid, etc. From step 120, process 100 may proceed to step 125 wherein a testing apparatus such as apparatus 52 will be calibrated. It is contemplated that a remanufacturing operation may be equipped to remanufacture various different types and sizes of friction elements. Thus, depending upon the particular style of friction element at issue, apparatus 52, and in particular reader 60, may be calibrated for a particular type of friction element each time a new group of machine systems is received for remanufacturing. Apparatus 52 might also be adjustable to accommodate different sized friction discs. Processor 70 might further include a memory configured to store calibration data corresponding to certain friction element material types, surface roughness, and other characteristics such that calibration is not always necessary.

From step 125, process 100 may proceed to step 130 wherein like discs may be aggregated, for example based on their part numbers. In some instances, similar discs might be grouped together, and even discs removed from one particular machine system might be processed as a group to enable return of any suitable ones to the same machine system from which they were removed, if desired. From step 130, process 100 may proceed to step 135 wherein the respective discs may be inspected for wear and defects such as chipping, embedded materials, warping, etc., as described herein. From step 135, process 100 may proceed to step 140 to query whether the discs have defects or excessive wear. If yes, defective discs may be sent to scrap as shown in step 145.

From step 140, any discs which do not have apparent defects may be subjected to a non-aqueous cleaning process, shown via step 150 in FIG. 3. From step 150, the discs may be loaded in a stack onto testing apparatus 52. At step 160, reader 60 may be used to transmit light toward one of the discs at an angle of incidence, for instance via emitters 62. It should be appreciated that beams of light, such as laser light, may be transmitted towards a plurality of different regions of each disc 20, and may also be transmitted at a plurality of angles of incidence. This may occur in a step-wise fashion, or multiple light beams may be transmitted simultaneously. From step 160, process 100 may proceed to step 165 wherein light reflected from the disc at an angle of reflectance may be sensed, for example via sensors 64.

From step 165, process 100 may proceed to step 170 wherein processor 70 may determine an index value based on a difference between the intensity of transmitted light and the intensity of reflected light. Similar to the manner described above, the index value might be an average reflectance value for a plurality of different regions of the disc face 22, and at a plurality of different angles of incidence/reflectance. From step 170, process 100 may proceed to step 175 wherein processor 70 may query whether the determined index value is within an acceptable range. If no, the subject disc may be sent to scrap 180 via actuating transfer and ejection device 55 with actuator 80 or by an operator. If the index value is determined to be within an acceptable range at step 175, process 100 may proceed to step 200 to sort the disc into a suitable category. From step 200, discs from the suitable category may be reassembled into the same or another clutch pack 310 which is positioned in a transmission 90. Process 100 may also return from step 200 to step 160 to scan another disc from the stack, repeating until all the discs are sorted. Process 100 may finish at step 210.

It should be appreciated that evaluation of each of the individual discs for wear, damage, warping or any other characteristic different from the reflectivity might be undertaken prior to evaluating the friction disc with apparatus 52, or after evaluating the friction disc with apparatus 52. It could be desirable in some instances, however, to inspect the discs for certain defects prior to subjecting them to a cleaning process, and also subjecting the discs to a final visual inspection after evaluating the reflectivity of the discs with apparatus 52.

The present disclosure will thus provide a means for reusing many friction elements which would otherwise be scrapped. The advantages of this are readily apparent. The strategy described herein is further relatively simple and straightforward. While various automated loading, cleaning, sorting and fixturing systems might be used, the basic concepts could be implemented by an operator having a handheld scanner. Further, while use of reader 60 is described in the context of determining reflectivity and, hence, whether discs 20 are glazed, the present disclosure is not strictly limited to determining glazing. Other characteristics of certain friction elements relating to their suitability for further service, such as whether they have been burned, may be revealed by examining various wave scattering properties of their frictionally interactive face(s).

The present description is for illustrative purposes only, and should not be construed to narrow the breadth of the present disclosure in any way. Thus, those skilled in the art will appreciate that various modifications might be made to the presently disclosed embodiments without departing from the intended spirit and scope of the present disclosure. For instance, while much of the foregoing description focuses on sensing light reflected from the frictionally interface face(s) of friction elements, other means for determining their relative reflectivity are contemplated. In one example, rather than sensing reflected light, scattered light might be sensed to give an indirect indication of the intensity of light that is reflected at an angle of reflectance. Other aspects, features and advantages will be apparent from an examination of the attached drawings and appended claims.

We claim:

1. A sorting process for used friction elements configured to transfer energy between components in a machine system comprising:

receiving friction elements removed from service in at least one machine system, each of the friction elements having at least one frictionally interactive face;

determining whether the friction elements are heat compromised based at least in part on a wave scattering property of the at least one frictionally interactive face; and sorting the friction elements into one of at least two categories based at least in part on whether the friction elements are heat compromised.

2. The sorting process of claim 1 wherein the at least one frictionally interactive face comprises a planar face, and wherein determining whether the friction elements are heat compromised further comprises transmitting light toward the planar face and sensing light reflected from the planar face.

3. The sorting process of claim 2 wherein determining whether the friction elements are heat compromised further comprises comparing an intensity of light transmitted toward the planar face at an angle of incidence with an intensity of light reflected from the planar face at an angle of reflectance.

4. The sorting process of claim 3 wherein comparing an intensity of light transmitted toward the planar face with an intensity of light reflected from the planar face comprises comparing an intensity of light transmitted toward the planar face at an angle of incidence with an intensity of light reflected from the planar face at an angle of reflectance that is equal to the angle of incidence.

5. The sorting process of claim 3 wherein the friction elements include friction disks configured to transfer torque between rotatable machine components, wherein the at least one face includes a first planar face and a second planar face disposed on opposite sides of each of the friction disks, and wherein determining whether the friction elements are heat compromised includes determining a wave scattering property of a plurality of separate regions of at least one of the first and second faces.

6. The sorting process of claim 5 further comprising determining whether a lubrication fluid type of the at least one machine system from which the friction elements are removed is a suitable fluid type, wherein sorting the friction elements further comprises sorting the friction elements based in part on determining whether the lubrication fluid type is a suitable fluid type.

7. The sorting process of claim 1 further comprising inspecting the friction elements for wear and inspecting the friction elements for damage prior to determining whether the friction elements are heat compromised.

8. The sorting process of claim 7 wherein inspecting the friction elements for wear further comprises determining a depth of preformed grooves in the at least one frictionally interactive face.

9. The sorting process of claim 7 further comprising inspecting the friction elements for embedded material prior to determining whether the friction elements are heat compromised.

* * * * *